US005769364A

United States Patent [19]

Cipollone

[11] Patent Number: 5,769,364

[45] Date of Patent: Jun. 23, 1998

[54] CODED TRACK CIRCUIT WITH DIAGNOSTIC CAPABILITY

[75] Inventor: Joseph Cipollone, Moreno Valley, Calif.

[73] Assignee: Harmon Industries, Inc., Blue Springs, Mo.

[21] Appl. No.: 856,460

[22] Filed: May 14, 1997

[51] Int. Cl.[6] ..... B61L 23/04

[52] U.S. Cl. ..... 246/34 B; 246/121

[58] Field of Search ..... 246/34 R, 34 B, 246/120, 121

[56] References Cited

U.S. PATENT DOCUMENTS

| | | | |
|---|---|---|---|
| 3,696,243 | 10/1972 | Risely | 246/121 |
| 4,065,081 | 12/1977 | Huffman et al. | 246/34 R |
| 4,117,529 | 9/1978 | Stark et al. | 246/34 R |
| 4,306,694 | 12/1981 | Kuhn | 246/125 |
| 4,498,650 | 2/1985 | Smith et al. | 246/122 R |
| 4,619,425 | 10/1986 | Nagel | 246/34 R |
| 4,728,063 | 3/1988 | Petit et al. | 246/34 R |
| 4,855,737 | 8/1989 | Poole | 246/473.1 |
| 4,886,226 | 12/1989 | Frielinghaus | 246/121 |
| 4,979,392 | 12/1990 | Guinon | 246/121 |
| 5,145,131 | 9/1992 | Franke | 246/122 R |
| 5,271,584 | 12/1993 | Hochman et al. | 246/34 B |
| 5,330,135 | 7/1994 | Roberts | 246/24 B |
| 5,417,388 | 5/1995 | Stillwell | 246/122 R |

*Primary Examiner*—S. Joseph Morano
*Attorney, Agent, or Firm*—Chase & Yakimo

[57] ABSTRACT

A track circuit with diagnostic capability differentiates between an occupied track circuit and one in which a conductor of the track circuit (one of the rails) is broken. Transceiver units are provided at the respective ends of the track circuit and operate alternately in transmit and receive modes. The applied voltage and current are measured at the transmitting unit, and the received voltage and current are sensed and measured at the receiving unit. From these measurements made successively as the units alternately transmit and receive, each unit can determine whether the track is available or unavailable and, if unavailable, whether the track has a broken rail. A microprocessor in each unit distinguishes a broken rail from an occupied track when an increase in the applied transmitting voltage at the unit occurs simultaneously with a decrease in each of the other voltage and current measurements.

8 Claims, 4 Drawing Sheets

CODED TRACK CIRCUIT WITH DIAGNOSTIC CAPABILITY

BACKGROUND OF THE INVENTION

This invention relates to improvements in coded track circuits used for railway signaling and detection of track occupancy and, more specifically, to a track circuit which is capable of distinguishing between an occupied track and a broken rail and which has greater reliability under widely varying environmental conditions.

A basic track circuit used on railroads for years to indicate the condition or occupancy of a track section or block utilizes a voltage source at one end of a track section and a voltage detection device, such as a relay, at the other end of the section. Current technology now additionally provides means for bidirectionally coding this energy to transmit and receive information through the rails, as well as track occupancy detection by the shunting action of the wheels of a train. These systems provide block occupancy information at both ends of the track circuit, as well as communicating occupancy in general through several track sections to a control point where the information may be transmitted to a central office for display.

Indication of an occupied block is provided by the rail-to-rail shunt between the wheels of an entering or already present train, which establishes a low resistance path and thus a loss of signal strength at the receiver at each end of the block. Indication of the track circuit as occupied is the safe state for the track circuit under failure, i.e., if the track circuit experiences some form of failure, the same indication is given as an occupied track to prevent rail vehicles from operating at high speed in that track section. A break in the rails also provides the same indication as an occupied track or a failure of one or more of the track circuit components.

A practical problem, however, arises from this lack of distinction between types of failures. The railroad personnel responsible for track circuit maintenance and rail repair are typically different persons belonging to different groups. Current practice is for track circuit maintenance personnel to isolate a track circuit failure, then contact the personnel responsible for rail repair if the rail is broken. A broken rail, therefore, can result in a long delay in rail traffic while one and then another maintenance crew is dispatched to effect repairs.

Furthermore, current systems require track circuit adjustment at both rail ends, concurrently, which requires two persons, one at one end of the track section in full communication with the person at the other end. The track circuit adjustment is typically fixed to the track circuit length without regard to then-existing rail leakage conditions in the track ballast (losses between the rails due to conductivity), which may in some cases result in overdriven circuits which later may not provide appropriate response to a shunt between the rails.

To properly maintain a track circuit, periodic tests are required to assure the equipment's capability to detect a shunted track, as well as, in many cases today, testing the track circuit relay or receiver for proper level of operation. These tests are currently performed manually at six month and two year intervals, respectively, by having track circuit maintenance personnel visit each site with appropriate test equipment.

SUMMARY OF THE INVENTION

It is, therefore, an important object of the present invention to provide a track circuit with diagnostic capability in order to differentiate between an occupied (or shunted) track circuit and one in which a conductor (rail) of the track circuit is broken.

Another important object is to provide a track circuit as aforesaid which is capable of limiting its adjustment range under operation to prevent a misadjustment that could result in failure to detect an occupied track or broken rail.

Still another important object of the invention is to provide such a track circuit capable of executing an operational self-check and logging data, and which may have an external interface to provide automatic reporting of results to a remote monitoring location.

In furtherance of the foregoing objects, the present invention provides timeshared bidirectional coding and receiving of track circuit energy to transmit and receive information through the rails, track occupancy status by the shunting action of the wheels of a train, and detection of a broken rail condition. Block occupancy and rail condition information is available at both ends of the track circuit, and means is provided for communicating the determined track status through several track sections to a control point where the information is transmitted to a central office for display.

A means for adjusting and measuring the track circuit currents at each end independently is also provided. Using an analog measurement of the rail transmit and receive current from the same end of the track circuit, a relative measure of the track current rail leakage conditions in the track ballast can be calculated to provide a track circuit adjustment made solely from one end of the track circuit which compensates for these leakages to provide an effective track circuit adjustment. The time and labor required to perform these adjustments is greatly reduced, as well as the improvement in the effectiveness of the final adjustment.

By monitoring the rail transmit and receive voltage and current levels continuously, the system distinguishes between a vehicle entering the track section and a broken rail. When the rail is shunted by a vehicle, voltage decreases, the transmitted currents increase and receiver levels decrease; whereas a broken rail will result in a decrease in both transmitted and received track circuit current while the transmitted voltage increases. A distinction can also be made as to which end of the track circuit an equipment failure has occurred. These distinctions, when properly communicated and reported, can be used by railroad maintenance supervisors to efficiently dispatch the appropriate crews to the correct location of failure to repair the track circuit, thus expediting repairs. This results in fewer train delays and a substantial savings to the railroad carrier and its customers.

The capability in the track circuit to measure its own transmit and receive current also provides a capability to test itself, eliminating the requirement for periodic testing of the track circuit receiver. Normal operation of the coded track circuit system can be made contingent on continued proper assurances of the circuitry self-tests. Therefore, a properly functioning track circuit already provides proper assurance of operation, eliminating the need for periodic external checks.

DETAILED DESCRIPTION

Figure 1:
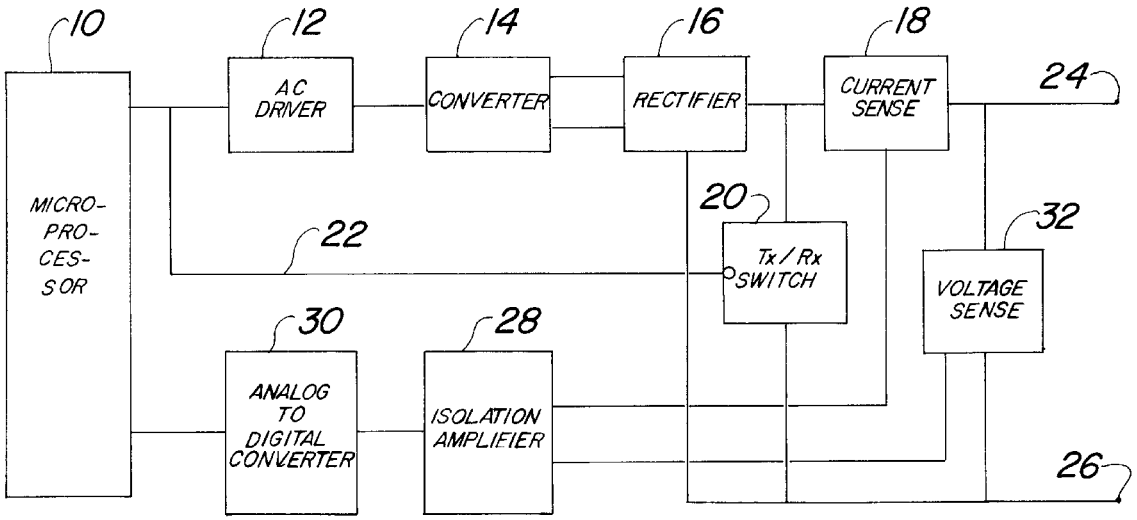
FIG. 1 is a block diagram of one of the transceiver units of the present invention utilized at the end of a track circuit.

FIG. 1 shows a transceiver unit of the present invention at one end of a coded track circuit as will be described. The unit includes a microprocessor 10 which controls the transmit and receive functions and a diagnostic procedure. Transmission to the rails is initiated by the microprocessor 10 by the application of an output signal to an AC driver 12 which provides excitation to a converter 14 that delivers a low-voltage, low-impedance alternating current (typically 2.5 volts) to a rectifier and filter circuit 16. This electrical energy is isolated from the unit's operating battery or power supply (not shown). The output from rectifier/filter circuit 16 is a direct current which is applied to the rails through a current sensing circuit 18. While transmitting to the rails, a transmit/receive switch 20 is disabled by microprocessor 10 via control line 22 to allow the full current to be presented at rail terminals 24 and 26. The transmitted current sensed by circuit 18 is applied to an isolation amplifier 28 which provides a corresponding level to be applied to an analog-to-digital converter 30 that inputs to the microprocessor 10 a digital value representing the transmitted current level.

Similarly, microprocessor 10 is provided with a digital voltage value by a voltage sensing circuit 32 responsive to the voltage across the rail terminals 24 and 26. Voltage sensed at 32 provides a check of operational levels generated, as well as determining actual load levels across the rail terminals. Transmission to the rails is ended by microprocessor 10 removing the signal to the AC driver 12 which ceases the generation of track circuit energy and enables (closes) the transmit/receive switch 20 to allow current to flow between the rail terminals 24 and 26 when a transceiver at the other end of the track circuit begins its transmission.

A typical track circuit transmission consists of one, two or three short DC pulses (80 to 250 milliseconds) with the pulses of a multiple-pulse burst being separated by brief intervals (80 to 950 milliseconds). These bursts are repeated at regular intervals (1.2 to 3.2 seconds) to define a receive interval between successive bursts during which energy from the other end of the track circuit may be received. Isolation of the rail energy from the unit's operating power provides assurances that certain circuitry failures cannot adversely affect the proper operation of the track circuit.

Figure 2:
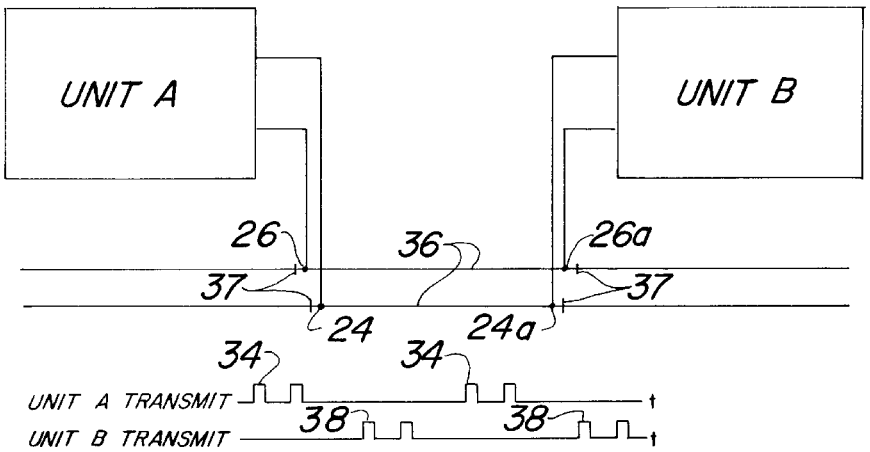
FIG. 2 is a block diagram showing two of the units of FIG. 1 connected to respective ends of a track circuit, and illustrates the bidirectionally transmitted coded signals.

FIG. 2 illustrates the connection of two of the transceiver units of FIG. 1 (unit A and unit B) to opposite ends of rails 36 that define a track circuit extending between rail terminals 24 and 26 of unit A and rail terminals 24*a* and 26*a* of unit B. The track circuit is isolated by insulated joints 37 as is conventional. FIG. 2 also illustrates the transmission of two bursts 34 from unit A separated by a receive interval, and two bursts 38 from unit B separated by a receive interval. The receive intervals of each unit occur during time periods that the other unit is transmitting.

To receive information transmitted from the other end of the track circuit, such as from unit B to unit A in FIG. 2, microprocessor 10 in unit A turns off the AC driver 12 and enables the transmit/receive switch 20 which now provides a low impedance shunt path (see RR1 or RR2 in FIG. 3) for currents on the rails to be received. Levels detected by the current sensing circuit 18 after conversion to digital form by the analog-to-digital converter 30 are presented to microprocessor 10 which samples these currents at regular intervals to detect recognizable patterns in the rail energy which would correspond to signals transmitted from the other end of the track circuit. Again, voltage sensed at 32 provides a check of operational levels received, as well as determining actual load levels across the rail terminals.

Figure 3:
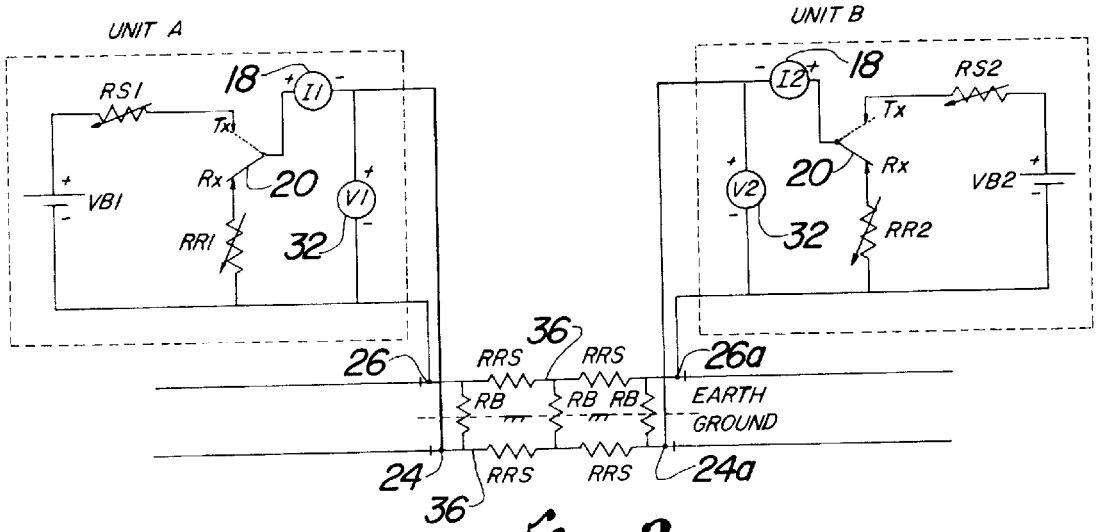
FIG. 3 is a schematic diagram of an equivalent circuit for the units and track shown in FIG. 2.

An equivalent circuit diagram for this system is presented in FIG. 3. The following information is measured and stored by the microprocessors 10 in both units A and B:

Unit A transmit mode: Transmitted voltage and current to the rail terminals 24 and 26, measured as V1 and I1 at unit A in FIG. 3.

Unit B receive mode: Received voltage and current at the rail terminals 24*a* and 26*a*, measured as V2 and I2 at unit B in FIG. 3.

Unit B transmit mode: Transmitted voltage and current to the rail terminals 24*a* and 26*a*, measured as V2 and I2 at unit B in FIG. 3.

Unit A receive mode: Received voltage and current at the rail terminals 24 and 26, measured as V1 and I1 at unit A in FIG. 3.

Referring to FIGS. 2 and 3, normal operation begins with unit A transmitting a pulse code 34 to the rails 36 while unit B is in the receive mode, and measuring the transmitted rail current I1 and voltage V1 across the rails at terminals 24 and 26. During the transmission, unit A measures and records the peak average transmitted current and voltage to the rails. When the transmit cycle at unit A is complete, unit A reverts to its receive mode and unit B transmits to the rails (code 38) while unit A measures the rail current in the shunt path through RR1 and voltage across the rails at its end (terminals 24 and 26). During its transmission, unit B measures and records the peak average transmitted current and voltage to the rails at terminals 24*a* and 26*a*. Units A and B thus operate alternately in transmit and receive modes as depicted by the spaced, successive pulse bursts 34 and 38.

As leakages between the rails vary (ballast resistance RB, FIG. 3, increases and decreases), the transmitter currents in both units will correspondingly decrease and increase. As a vehicle enters the rail section, its wheels short across the rails and an increase in transmitted rail current is measured at both ends of the circuit. Since the transmitter has a limiting resistance (RS1 and RS2, FIG. 3), a vehicle shunting the rails will also lower the voltage measured at V1 and V2.

Figure 4:
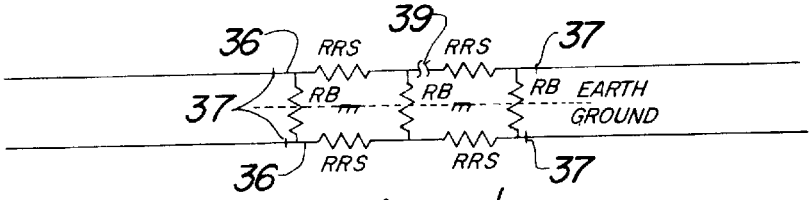
FIG. 4 is a broken rail equivalent circuit.

In the description to follow it is assumed that unit A is transmitting and unit B is in the receive mode. The resistances represented by RS1 (transmit) and RR2 (receive) in FIG. 3 are set to provide maximum response to a vehicle shunting the rails, which is typically specified as a maximum shunt resistance (short across the rails) of not more than 0.06 ohm. When RS1 is approximately 0.3 ohm and RR2 is approximately 0.5 ohm, changes in RB absent a shunt must not reduce the received current at I2 below a fixed threshold (typically 600 milliamperes when VB1=2.5 VDC). When the rails are shorted by a vehicle's axles, the receiver current (I2, FIG. 3) measures below this threshold while a decrease in transmitted voltage at V2 is measured during unit B's transmit cycle, and occupancy is detected. As a break develops in the rails (illustrated at 39, see FIG. 4), again the receiver current (I2, FIG. 3) will decrease below the fixed threshold, but the voltage measured at V2 will increase during unit B's transmit cycle because of the decreased load on VB2. Similarly, the same effect will be observed at unit A. The microprocessors 10 in units A and B thus differentiate between shunted rails and a broken rail in this manner as illustrated in the flow charts, FIGS. 5 and 6, and can also log and record this information as well as modify the information transmitted into an adjacent track circuit to report the condition back to a control location where it can be relayed to appropriate maintenance personnel.

Leakages between the rails, represented as RB in FIG. 3 (referred to as the track ballast), will vary during environmental changes typically between 5 and 1,000 ohms per thousand feet of rail. Some extremes may occur outside this range, but these are typically observed in less than 5% of Class I railroad track circuits. The actual equivalent load on the track transmitter can be an important factor in correctly installing and adjusting the track circuit for proper vehicle detection. For example, if a 10,000-foot track circuit is adjusted such that the receiver current is 1.2 amperes while the track ballast is wet, representing 5 ohms per thousand feet, and then the track ballast freezes, the track ballast could well exceed 1,000 ohms per thousand feet of track. The receiver current, which was previously adjusted at 1.2 amperes, may now exceed 2.0 amperes, and the track circuit may not be adequately shunted by a vehicle such that the receiver current during vehicle occupancy may exceed the threshold of 600 milliamperes if the ratio of vehicle shunt impedance to the receiver impedance is greater than 0.6:2, or 0.3. It is important, therefore, for proper track circuit operation over wide ballast swings, to limit the adjustment range of received currents if the track ballast is low during adjustment.

Referring to FIG. 3, if it is assumed that VB1 and VB2, RS1 and RS2, and RR1 and RR2 are relatively similar in value, then, when RB is low in resistance, the transmitter current is high and receiver current is low. Conversely, when RB presents a high resistance, the transmitter current approaches the same value as the receiver current. Accordingly, the relative values of I1 and I2 for transmit and receive cycle currents, measured when the track is unoccupied, can provide a relative measure of the total equivalent load between the track rails. When adjusting the track circuit to a fixed threshold for occupancy detection, a more accurate adjustment can be made when this relative load is known, and a limit can be set on the maximum receiver current. The microprocessor 10 in each unit can limit the maximum receiver current during adjustment based on the difference in transmit and receive currents during track circuit adjustment. For a fixed threshold of 600 milliamperes, the following formula provides an accurate limit on receiver adjustment current:

$$I_{max}=1.4-((I_{transmit}-I_{receive})/2),\text{ but not less than 0.80 ampere.}$$

Figure 5:
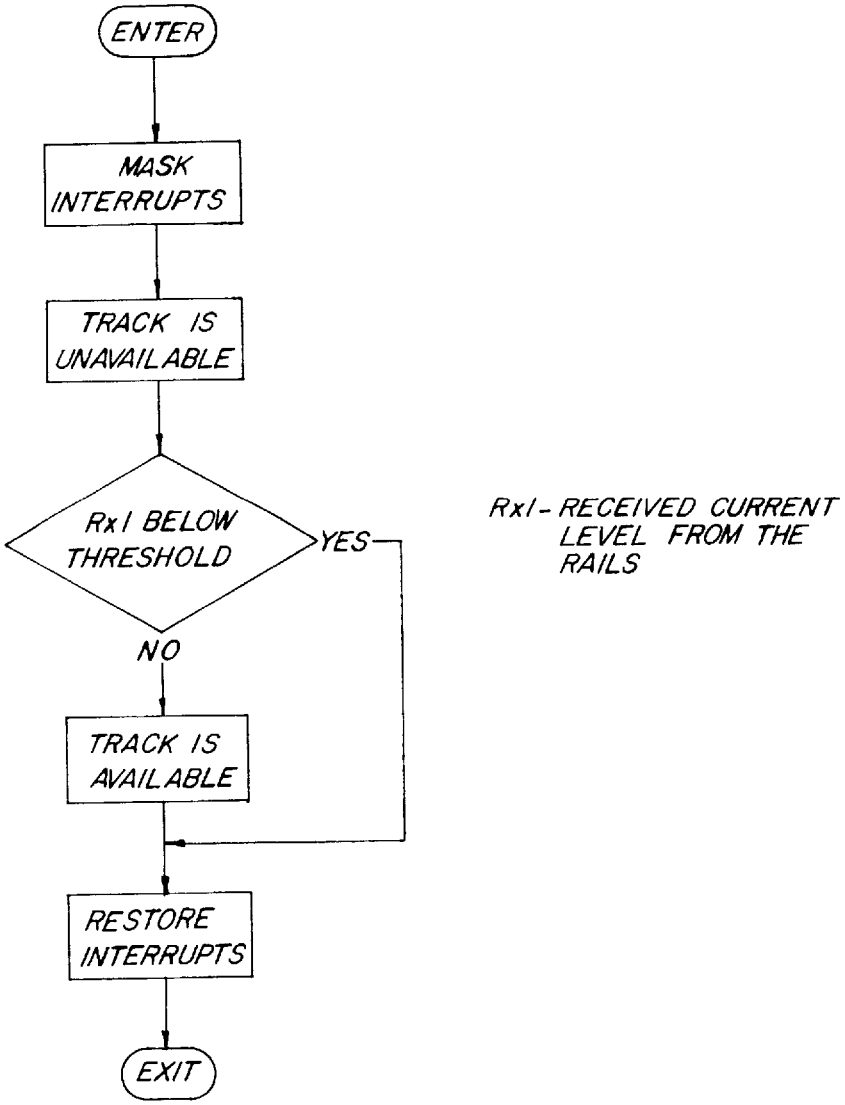
FIG. 5 is a vital software flow chart.
Figure 6:
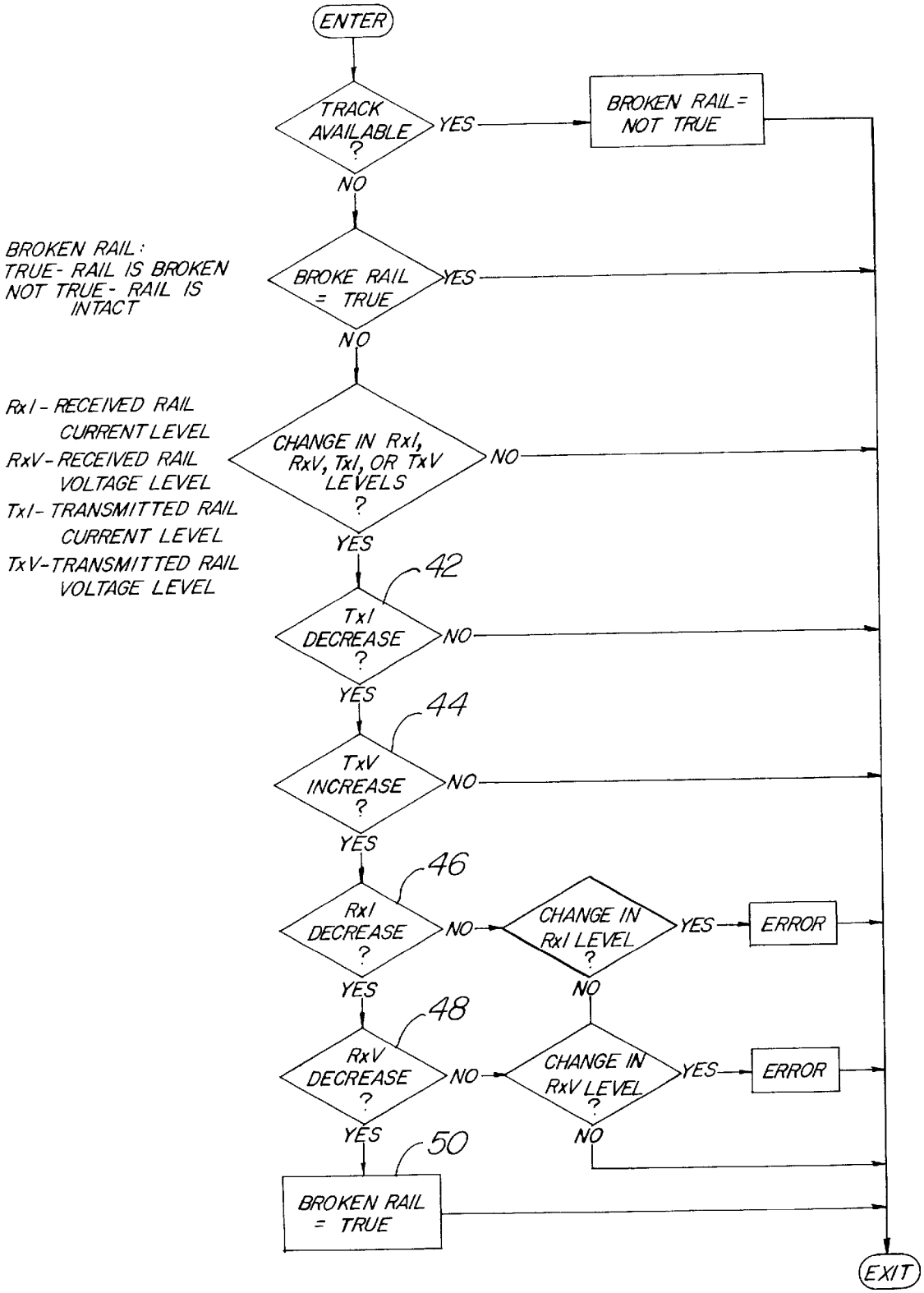
FIG. 6 is a non-vital software flow chart.

The vital and non-vital software for the microprocessor 10 of each of the units A and B is shown in FIGS. 5 and 6 respectively. The vital software is typical for a microprocessor-controlled coded track circuit that, in addition to transmitting coded information as to wayside signal aspects, etc., also determines track occupancy status. The non-vital software of the present invention illustrated by the flow chart in FIG. 6 and the accompanying legends enables the microprocessor to distinguish between an occupied track and a broken rail in accordance with the voltage and current data gathered by unit A or unit B as described above.

If the result of the availability test conducted in the usual manner by the vital software (FIG. 5) indicates that the track is unavailable (i.e., RxI is below threshold), the non-vital software proceeds as indicated by decision blocks 42, 44, 46 and 48 in FIG. 6 to determine if there is a broken rail. If the transmitted rail current level at a particular unit A or B decreases, transmitted voltage increases, received current decreases, and received voltage indicated by a display (not shown) on the unit. As discussed above, this determination may also be transmitted to a remote monitoring location for action by maintenance personnel.

Having thus described the invention, what is claimed as new and desired to be secured by Letters Patent is as follows:

1. A method of detecting the operational condition of a railroad track comprising:

(a) providing first and second units connected to the track at spaced locations along the track, each of said units having a transmit mode in which a voltage is applied to the track at the respective location, and said first unit having a receive mode in which a voltage on the track and current flowing therein are sensed, (b) operating said first unit in the transmit mode and measuring the applied voltage on the track and the transmitted current, (c) thereafter operating said second unit in the transmit mode, and simultaneously operating said first unit in the receive mode and measuring the received voltage and current, (d) repeating said steps (b) and (c), and (e) determining from the successive voltage and current measurements made at said first unit whether the track between said locations is available or unavailable and, if unavailable, whether the track has a broken rail.

2. The method as claimed in claim 1, wherein said step (e) includes determining that the track has a broken rail in response to an increase in the applied voltage when said first unit is in the transmit mode, and a decrease in each of the other voltage and current measurements.

3. A method of detecting the operational condition of a railroad track comprising:

(a) providing first and second units connected to the track at spaced locations along the track, each of said units having a transmit mode in which a voltage is applied to the track at the respective location, and a receive mode in which a voltage on the track and current flowing therein are sensed, (b) operating said first unit in the transmit mode and measuring the applied voltage on the track and current flowing therein, and simultaneously operating said second unit in the receive mode and measuring the sensed voltage and current flowing in the track, (c) thereafter operating said second unit in the transmit mode and measuring the applied voltage on the track and current flowing therein, and simultaneously operating said first unit in the receive mode and measuring the sensed voltage and current flowing in the track, (d) repeating said steps (b) and (c), and (e) determining from the voltage and current measurements made at one of said units whether the track between said locations is available or unavailable and, if unavailable, whether the track has a broken rail.

4. The method as claimed in claim 3, wherein said step (e) includes determining that the track has a broken rail in response to an increase in the applied voltage measured when said one unit is in its transmit mode, a decrease in the current measured when said one unit is in its transmit mode, and a decrease in the sensed voltage and current measured when said one unit is in the receive mode.

5. Apparatus for detecting the operational condition of a railroad track comprising:

first and second units, means for electrically connecting said first unit to a first end of a track circuit, means for electrically connecting said second unit to a second end of said track circuit, each of said units having a transmit mode for applying a voltage to the respective end of said circuit, and said first unit having a receive mode for sensing a voltage at said first end and current flowing in the track circuit at said first end, said first unit having means for operating the unit alternately in the transmit mode and the receive mode, and for measuring the transmitted and received voltage and current at said first end, said second unit having means for operating the second unit in the transmit mode when said first unit is in the receive mode, and said first unit further having means for determining from successive voltage and current measurements made at said first end whether the track between said ends is available or unavailable and, if unavailable, whether the track has a broken rail.

6. The apparatus as claimed in claim 5, wherein said determining means indicates that the track has a broken rail in response to an increase in the voltage applied by said first unit in the transmit mode, and a decrease in the transmitted current and the received voltage and current measurements.

7. Apparatus for detecting the operational condition of a railroad track comprising:

first and second units, means for electrically connecting said first unit to a first end of a track circuit, means for electrically connecting said second unit to a second end of said track circuit, each of said units having a transmit mode for applying a voltage to the respective end of said circuit, and a receive mode for sensing a voltage at the respective end and current flowing therein, said units having means for operating the units alternately in the transmit mode and the receive mode to cause each unit to transmit while the other is receiving, and for measuring the transmitted and received voltage and current at the respective ends of the track circuit, and each of said units further having means for determining from successive voltage and current measurements made at its end whether the track between said ends is available or unavailable and, if unavailable, whether the track has a broken rail.

8. The apparatus as claimed in claim 7, wherein said determining means in each unit indicates that the track has a broken rail in response to an increase in the applied voltage measured when the unit is in its transmit mode, a decrease in the current measured when the unit is in its transmit mode, and a decrease in the sensed voltage and current measured when the unit is in the receive mode.

* * * * *